US006899333B2

(12) United States Patent
Weisman

(10) Patent No.: US 6,899,333 B2
(45) Date of Patent: May 31, 2005

(54) GAME PIECE AND METHOD OF PLAYING A GAME AND SUPPLYING THE GAME PIECE

(75) Inventor: Jordan K. Weisman, Redmond, WA (US)

(73) Assignee: Wizkids, LLC, Bellevue, WA (US)

( * ) Notice: Subject to any disclaimer, the term of this patent is extended or adjusted under 35 U.S.C. 154(b) by 88 days.

(21) Appl. No.: 10/243,980

(22) Filed: Sep. 13, 2002

(65) Prior Publication Data

US 2003/0071414 A1 Apr. 17, 2003

Related U.S. Application Data

(63) Continuation-in-part of application No. 09/958,201, filed on Oct. 5, 2001.

(51) Int. Cl.[7] ..... A63F 9/00

(52) U.S. Cl. ..... 273/289; 288/142 H

(58) Field of Search ..... 273/237, 238, 273/280, 289, 281, 142 H, 288, 284

(56) References Cited

U.S. PATENT DOCUMENTS

| | | | | | |
|---|---|---|---|---|---|
| 1,762,269 | A | | 6/1930 | Harris | |
| 3,856,309 | A | | 12/1974 | Helfgott | |
| 3,945,640 | A | | 3/1976 | Denmark | |
| 4,083,564 | A | | 4/1978 | Matsumoto | |
| 4,116,449 | A | * | 9/1978 | Breslow | 273/240 |
| 4,211,410 | A | | 7/1980 | Smith | |
| 4,498,674 | A | | 2/1985 | Ferris et al. | |
| 4,534,567 | A | | 8/1985 | Ferris et al. | |
| 4,634,129 | A | | 1/1987 | Martinez | |
| 4,941,665 | A | | 7/1990 | Klamer | |
| 4,948,135 | A | | 8/1990 | Follety, Jr. | |
| 4,973,053 | A | | 11/1990 | Kobayashi | |
| 5,211,403 | A | | 5/1993 | Ostrander | |
| 5,340,105 | A | | 8/1994 | Gostyla | |
| 5,484,287 | A | | 1/1996 | Concepcion-Diaz | |
| 5,584,484 | A | | 12/1996 | Kenvyn | |
| 5,758,777 | A | | 6/1998 | Dods | |
| 5,927,715 | A | | 7/1999 | Novello | |
| 5,959,281 | A | * | 9/1999 | Domiteaux | 235/454 |
| 6,533,275 | B2 | * | 3/2003 | Zaruba et al. | 273/146 |
| 6,659,463 | B2 | | 12/2003 | Mackay | |
| 2002/0180150 | A1 | | 12/2002 | Weisman | |
| 2003/0094759 | A1 | * | 5/2003 | Niedner et al. | 273/255 |

OTHER PUBLICATIONS

The Adventurers Guide to Darkworld, 1992, 10pages, Mattel Inc., El Segundo, California, USA.

Mattel Dark World Game, eBay item 565530968, Mar. 8, 2001, http://cgi.ebay.com/aw–cgi/eBavISAPI.dll?ViewItem&item=565530968.

Mattel Dark World Game like Heroquest + XTRAS, eBay <http://cgi.ebay.com/aw–cgi/eBayISAPI.dll?ViewItem&item=565530968>, downloaded Mar. 8, 2001.

* cited by examiner

*Primary Examiner*—Benjamin Layno
(74) *Attorney, Agent, or Firm*—George C. Rondeau, Jr.; Davis Wright Tremaine LLP

(57) ABSTRACT

A method and an apparatus by which rules and record-keeping in games employing miniature figures as game pieces are incorporated onto the base of the miniature figures themselves. Printed information relating to the characteristics of a character are inserted into the base of the figure to customize the values for each character. The base is adapted to keep track of how the characteristics of a character change as a game progresses. Also, a method for playing a game using such game pieces and printed information.

12 Claims, 7 Drawing Sheets

Fig. 10

***Move* Special Abilities**

Red: *Quickness*. This warrior may not be part of a *Movement Formation*. You may give this warrior a *Move* action which does not count against your "one action per turn" limit. You may not give this warrior two actions during the same turn. Use of this ability is optional.

Light Blue: *Aquatic*. This warrior is unhindered while moving through water terrain features. This warrior may move through water at full *speed* value. Use of this ability is optional.

Orange: *Flight*. This warrior is capable of short-range flight. Movement of this warrior is never blocked by figure bases or blocking terrain. The presence of hindering terrain does not halve this warrior's *speed* value. This warrior still has to roll a die to *Move* if it is in contact with an opposing warrior's base. Use of this ability is optional.

Black (White Type): *Stealth*. A *Line of Fire*, drawn to this warrior, which passes through any hindering terrain, is treated as though it has been drawn through blocking terrain. Use of this ability is optional.

***Attack* Special Abilities**

Medium Green: *Healing*. This warrior may use the *Close Combat* action against friendly figures, and if a hit is obtained, this warrior's *damage* value repairs that many clicks to the friendly target figure instead of inflicting damage. Use of this ability is optional. This warrior may make a *Close Combat* attack normally.

Red: *Melee Specialist*. Whenever this warrior scores a hit with a *Close Combat* attack, roll one six-sided die. This is the number of clicks of damage you deliver to the target figure. Do not use this warrior's normal *damage* value. Use of this ability is optional.

Light Blue: *Magic Attack*. When this warrior is given a *Ranged Combat* action, the *Line of Fire* is never considered blocked or hindered by the presence of terrain or other figures. Whenever this warrior scores a hit with this attack, roll one six-sided die. This is the number of clicks of damage you deliver to the target figure. Do not use this warrior's normal *damage* value. Use of this ability is optional.

Orange: *Flame/Lightning*. This warrior's *Ranged Combat* attacks are never blocked by the bases of other figures. All figure bases (friends and foes) intersected by the *Line of Fire* are affected by the attack roll. Only one dice roll is made, but multiple targets can be affected.

Yellow: *Psionic Blast*. Any *Ranged Combat* action you give this warrior affects every other figure (friends and foes) within a circle around this warrior out to its *range* value. *Lines of Fire* are never considered blocked or hindered by the presence of terrain or other warriors.

Black (White Type): *Vampirism*. Whenever this warrior deals any amount of damage to a target figure during a *Close Combat* attack, you may repair one click to this warrior.

Grey: *Magic Healing*. This warrior may use the *Ranged Combat* action against friendly figures, and if a hit is obtained, this warrior's *damage* value repairs that many clicks to the target instead of inflicting damage. Use of this ability is optional. This warrior may make a *Ranged Combat* attack normally.

GAME PIECE AND METHOD OF PLAYING A GAME AND SUPPLYING THE GAME PIECE

RELATED APPLICATIONS

This application is a continuation-in-part of U.S. patent application Ser. No. 09/958,201, filed Oct. 5, 2001, the entire contents of which is incorporated by reference herein.

FIELD OF THE INVENTION

The invention relates to games involving the use of miniatures to represent characters in the games.

BACKGROUND OF THE INVENTION

A degree of realism can be added to games, especially war and fantasy games, through the use of miniature figures to represent characters in the games. Each participant in the game manipulates characters, each represented by a miniature figure and each being endowed with certain characteristics, e.g., strength and range of movement, that enter into the resolution of a given event, such as a battle or other interface between characters. As the complexity of each character and each scenario grows, and as the number of characters increases, the complexity of the game increases.

The more complicated prior art games require voluminous rules of play manuals. These manuals include massive amounts of rules and statistics for all of the figures in the game. The number of included statistics makes it difficult for a player to find a specific figure's statistics. In addition, a player is limited to figures included in their specific manual. Further, the rules often entail detailed record-keeping by the players, which are often recorded on miscellaneous slips of paper that can become misplaced or disorganized.

SUMMARY OF THE INVENTION

One challenge of miniature games for a broad audience has always been the size and complication of the rules and the need for record-keeping for each figure within the game. The solution to this problem is to take both the statistics pertaining to a specific character and the recording of game effects upon that character and incorporate them within each figure. In addition, the statistics pertaining to a specific character can be provided as separate printed information, such as a trading card, for use with the figure.

Accordingly, the invention described herein provides a method and an apparatus by which rules and record-keeping are incorporated onto the game piece base of the miniature figures themselves. Therefore, a player can use the purchased figures immediately in a game, as opposed to first finding the correct statistics book for that specific character. One embodiment of the invention uses counter-wheels having numbers, colors, or other indicia that reflect the nature and values of a character's characteristics and how they change as a game progresses. Values can be customized for each character by providing differently-numbered wheels for the game piece bases.

In the illustrated embodiment, the nature and values of a character's characteristics are provided as separate printed information, such as a trading card. It is understood, however, that this separate printed information may be printed on any material suitable for use with the game piece base as described in the application. This may include a plastic disk or wafer, a pressed paper or cardboard card, or any other suitable materials.

In another embodiment, characteristics for a character can be defined by the combination of the separate printed information and the game piece base itself.

The game playing may be performed using game piece bases with or without an attached figure. In the illustrated embodiment, the attached figure is a representative figure of a character in the game. In other embodiments, however, the figure may be a ring, a tab or any other figure that would facilitate turning the game piece for record-keeping.

Other features and advantages of the invention will become apparent to those skilled in the art upon review of the following detailed description, claims, and drawings.

BRIEF DESCRIPTION OF THE DRAWINGS

FIG. 9 is perspective view of yet another embodiment of the game piece illustrated in FIG. 1, including a representational figure.

FIG. 10 is a sample of a special abilities card to be used with a game piece such as that illustrated in FIG. 1.

Figure 1:
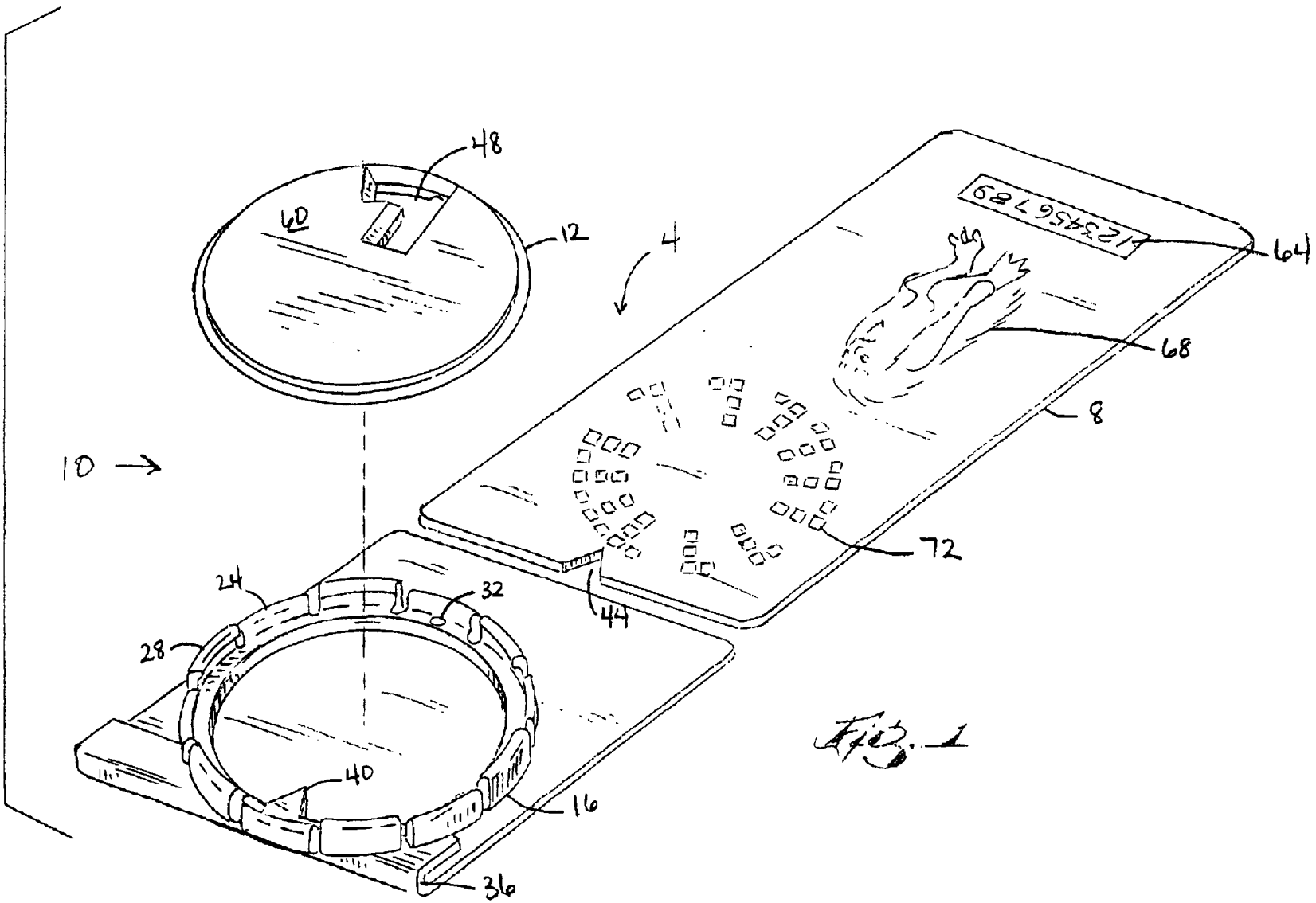
FIG. 1 is an exploded view of a game piece embodying the invention.
Figure 2:
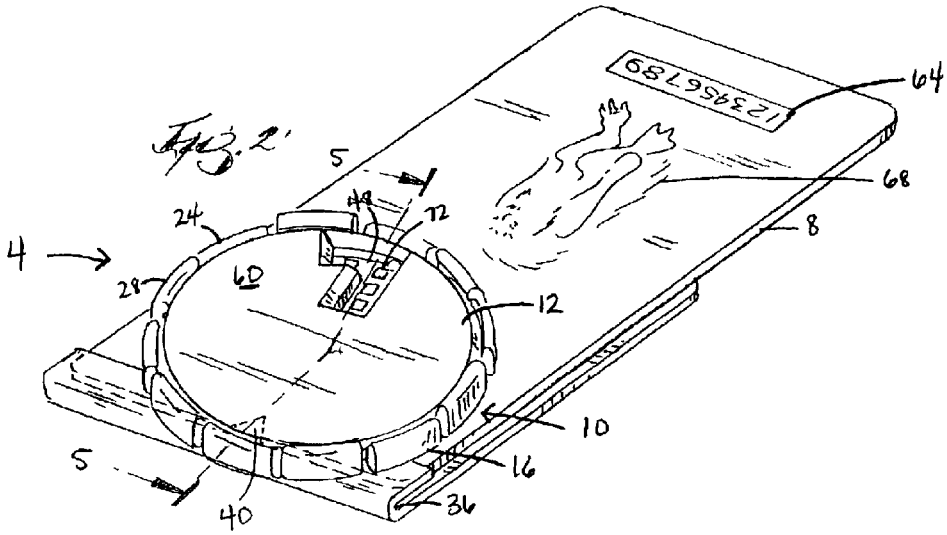
FIG. 2 is a perspective view of the game piece illustrated in FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE ILLUSTRATED EMBODIMENT

Miniature figures are often used in games, especially war and fantasy games, to represent characters in the games. These characters, for example, can be a Roman legionnaire, a Civil War Union soldier, a magician, or a mythical beast, depending on the game. Games can be played to re-enact historical battles, such as the Spartan defense of Thermopylae against the invading Persian army under King Xerxes, or to create a fantastical battle such as one pitting elves and humans against trolls and orcs. Each participant in the game commands an army of characters, each represented by a miniature figure. Each character is endowed with certain strengths and weaknesses, all of which enter into the resolution of a given battle. To add interest to the battle, other factors such as magic and terrain can also be included.

As the complexity of each character and each scenario grows, and as the number of characters increases, the complexity of the game increases. The challenge of miniature games for players is the extensive and complicated nature of the rules and the need for record-keeping for each figure within the game. In this description, the terms warrior and game piece are used interchangeably to describe the invention.

FIG. 1 illustrates a game piece 4 designed to ease the complexity of such games. Separate variable printed information 8 related to the game is insertable into and interchangeable with the game piece 4 to selectively provide information about a specific character in the game. Each game piece 4 adjustably displays the variable printed information 8 and includes a base 10. The base 10 includes a base disk 12 and a selector disk 16.

Figure 7:
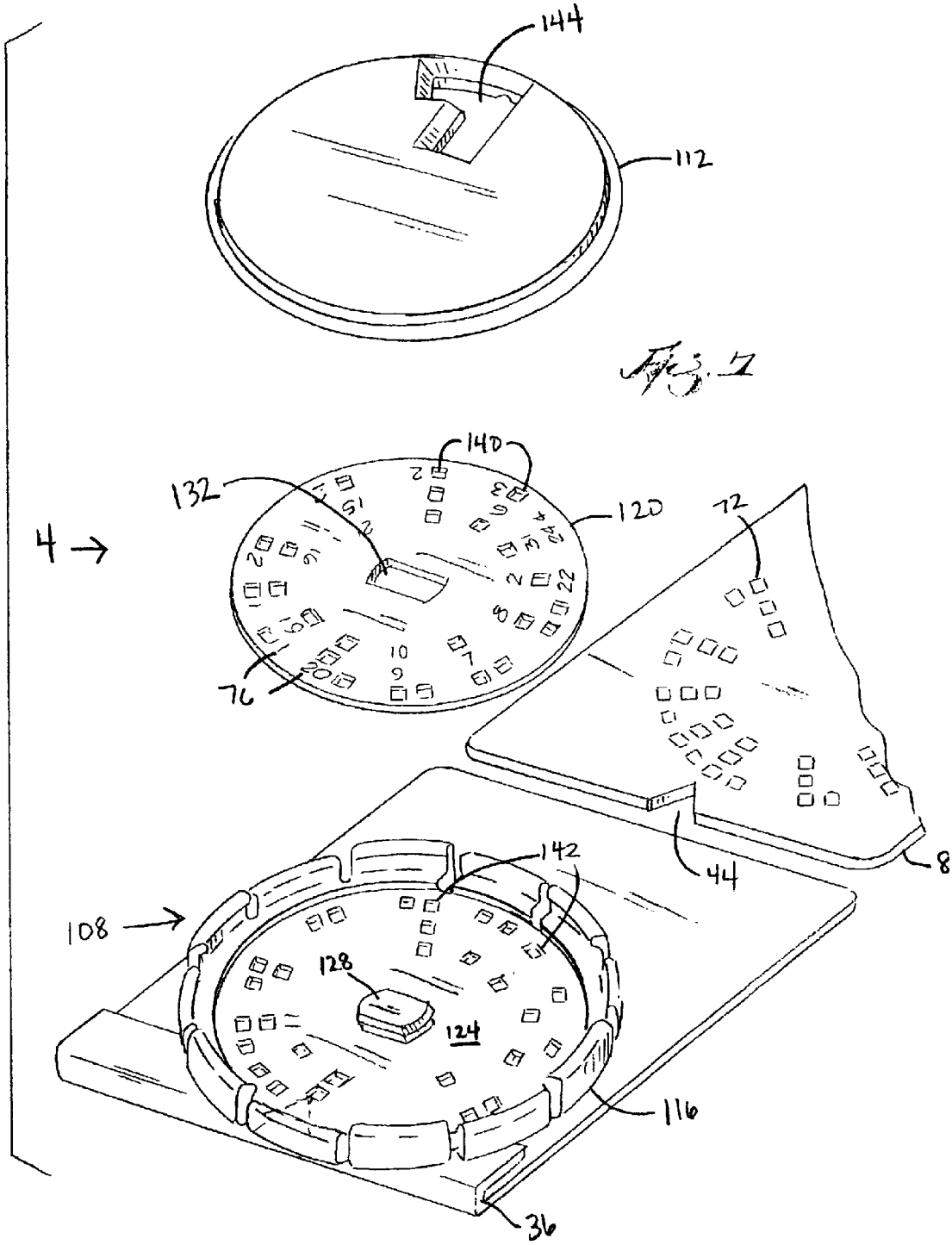
FIG. 7 is an exploded view of another embodiment of the game piece.

The selector disk 16 includes a plurality of fingers 24, 28 mounted at the periphery of the selector disk 16. The plurality of fingers 24, 28 include six short fingers 24 alternating with six long fingers 28. In other embodiments, any other suitable number or sizing of fingers may be used. One of the fingers 24, 28 includes a button 32 formed therewith and rising vertically from the selector disk 16. As shown in FIG. 1, the selector disk 16 is in the form of a disk with the center surface removed (i.e. a ring). As shown in FIG. 7, other embodiments retain the center surface 124 of the disk.

Figure 5:
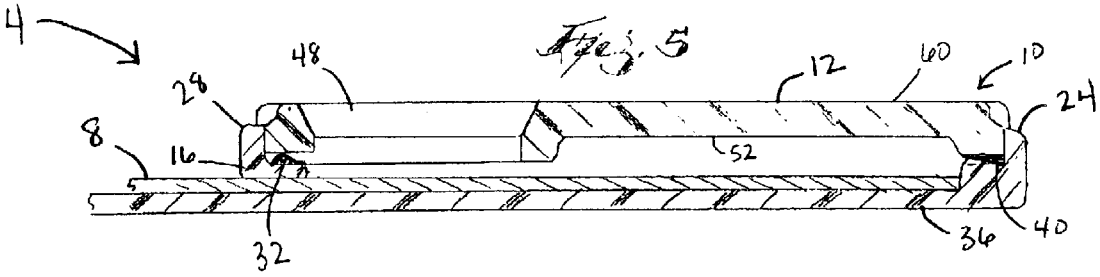
FIG. 5 is a cross-section view taken along line 5—5 in FIG. 2.

The selector disk 16 further includes a structure to receive and support the interchangeable printed information 8, such as a clip 36, attached to the bottom of the selector disk 16. As best shown in FIG. 5, the selector disk 16 also includes a mechanism, such as a notch 40, and the printed information 8 includes a recess 44 that matches the shape of the notch 40 to align the printed information 8 with the base 10 so that the game piece 4 properly displays the variable information. As the printed information 8 is inserted into the base 10, the recess 44 receives the notch 40 on the selector disk 16.

Figure 3:
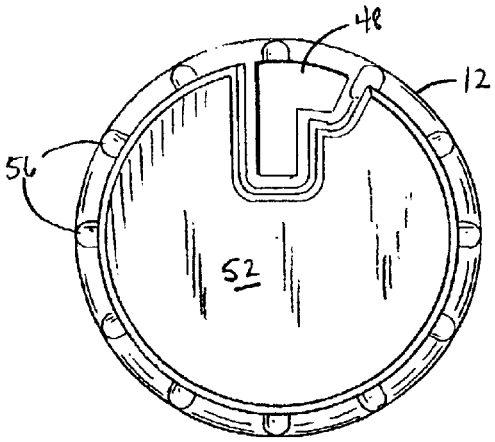
FIG. 3 is a plan bottom view of a base disk of the game piece illustrated in FIG. 1.
Figure 4:
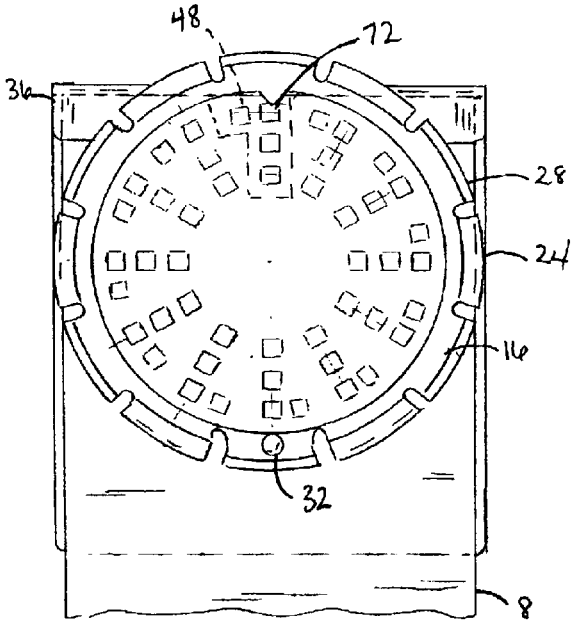
FIG. 4 is a plan top view of a selector disk of the game piece illustrated in FIG. 1.

The base disk 12 includes an L-shaped stat slot or aperture 48 that allows one set of numbers and additional data from the printed information 8 to be seen at a given position of the base disk 12 relative to the selector disk 16. As illustrated in FIG. 3, the base disk 12 also includes a bottom surface 52, and a plurality of indentations 56 in the periphery of the bottom surface 52. The number of indentations 56 can match the number of fingers 24, 28 on the selector disk 16. The base disk 12 also includes an upper surface 60.

When assembled, as illustrated in FIG. 5, the base disk 12 fits within and is captured by the fingers 24, 28 of the selector disk 16. This arrangement allows the selector disk 16 to be rotated relative to the base disk 12 or the base disk 12 to be rotated relative to the selector disk 16. The button 32 interacts with the indentations 56 such that the button 32 resides partially within an indentation 56 when that indentation 56 is aligned with the button 32. The fingers 24, 28 are sufficiently flexible to allow the button 32 to snap into and out of an indentation 56 as the selector disk 16 and base disk 12 are rotated relative to each other. Such an arrangement ensures that the base disk 12 will only occupy a given number of discrete indexed positions relative to the selector disk 16, where the given number of discrete positions is equal to the number of indentations 56, and where each discrete position allows a player to look through the slot 48 to see whatever numbers, symbols, or colors may appear on the printed information 8 at that location. In other words, the base disk 12 and selector disk 16 are typically aligned such that a set of numbers appears in the slot 48. The fingers 24, 28 provide a gripping surface such that a player can manually rotate the selector disk 16 relative to the base disk 12.

Figure 6:
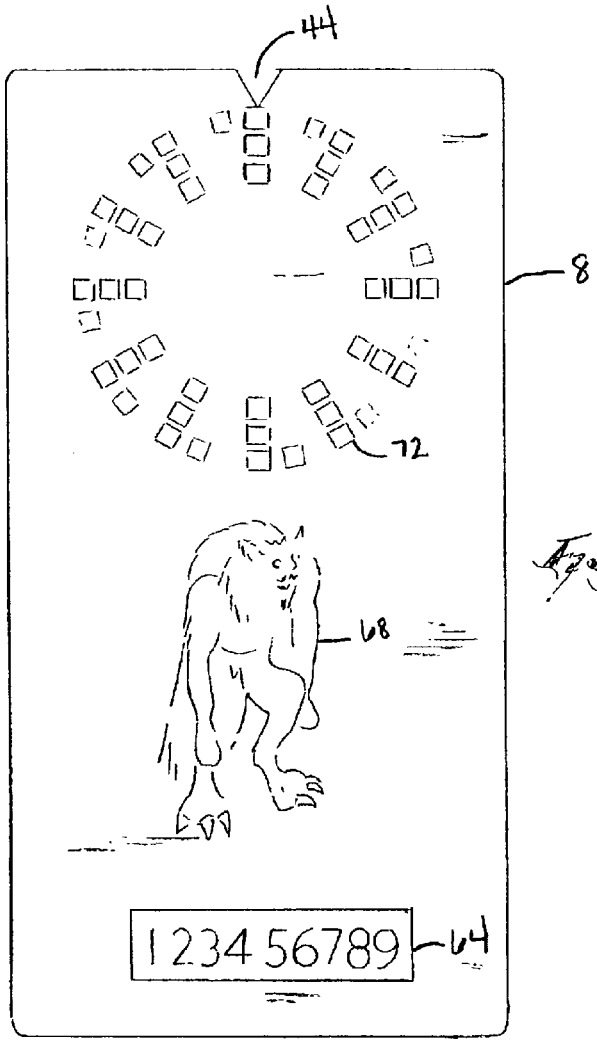
FIG. 6 is a plan front view of the printed information to be used with the game piece illustrated in FIG. 1.

The printed information 8 for use with the game piece 4 is illustrated in FIG. 6. The printed information 8 is shown here as a trading card. In other embodiments, the printed information 8 may be an interchangeable disk or label, such that the base disk 12 may be removed from the selector disk 16 to allow a player to change the label that contains the variable information. The trading card 8 includes identification information 64 about a character in the game, an illustration 68 of a character in the game, variable information 72 relating to the statistics for that character and the recess 44 for aligning the card 8 with the game piece 4. A series of numbers in twelve sets of four appears on the printed information 8. Each column is spaced at approximately thirty-degree intervals around the printed information 8. In alternate embodiments, any other suitable arrangement of numbers can be used.

As shown, the recess 44 is located along the top edge of the card 8. However, it is understood that the recess 44 could be located along any edge of the card 8. It is further understood that other methods may be used to align the card with the game piece. For example, the game piece 4 could include a raised edge to align with the top edge of the card 8 and the clip 36 could bias the card 8 toward the game piece 4 to prevent it from moving out of alignment. Another possible method might include the use of high friction material for the card 8 and/or the clip 36 to prevent the card from moving once it is properly placed. It is also understood that in other embodiments, one card 8 could contain multiple sets of variable information 72 and multiple recesses 44 so that a player could choose which set of variable information 72 to use for that game and could accordingly align the card 8 with the game piece 4. The variable information 72 relating to the statistics for the character is arranged in sets, such that only one set may be viewed at a time through the stat slot 48 in the game piece base 10.

Another embodiment of the claimed invention is illustrated in FIG. 7. In this embodiment, some of the character's information 76 is provided on the game piece 4 and some is provided on the printed information 8. The additional variable information 76 provided on the game piece 4 represents characteristics that are inherent to the character represented by the game piece 4. The game piece 4 includes a base 108, a base disk 112, a label 120 and a selector disk 116. The selector disk 116 includes a center surface 124 and a post 128. The label 120 has an aperture 132 therein to align the label 120 with the post 128 on the selector disk 116. In this embodiment, the label 120 contains sets of additional variable information 76 similar to the printed information 8 as described above. However, within each set on the label, cut-out windows 140 are alternated with the character information 76. The selector disk 116 also has matching cut-out windows 142 so that when the printed information 8 is inserted into the base 108, some of the printed information 8 shows through the windows 140, 142 in both the selector disk 116 and the label 120. This printed information 8, along with the additional variable information 76, can be viewed through a stat slot 144 in the game piece 4.

Figure 8:
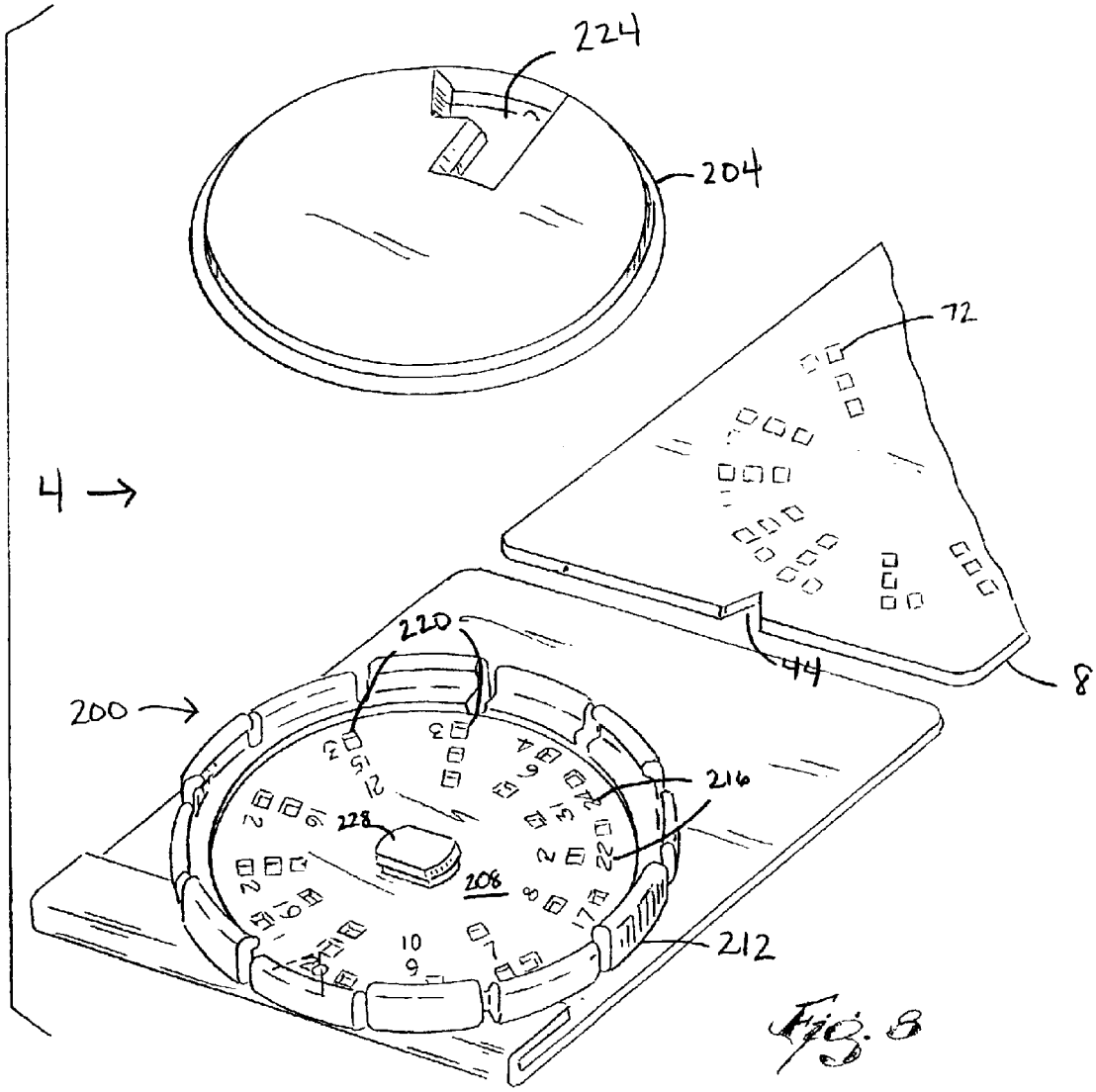
FIG. 8 is an exploded view of an additional embodiment of the game piece.
Figure 3:
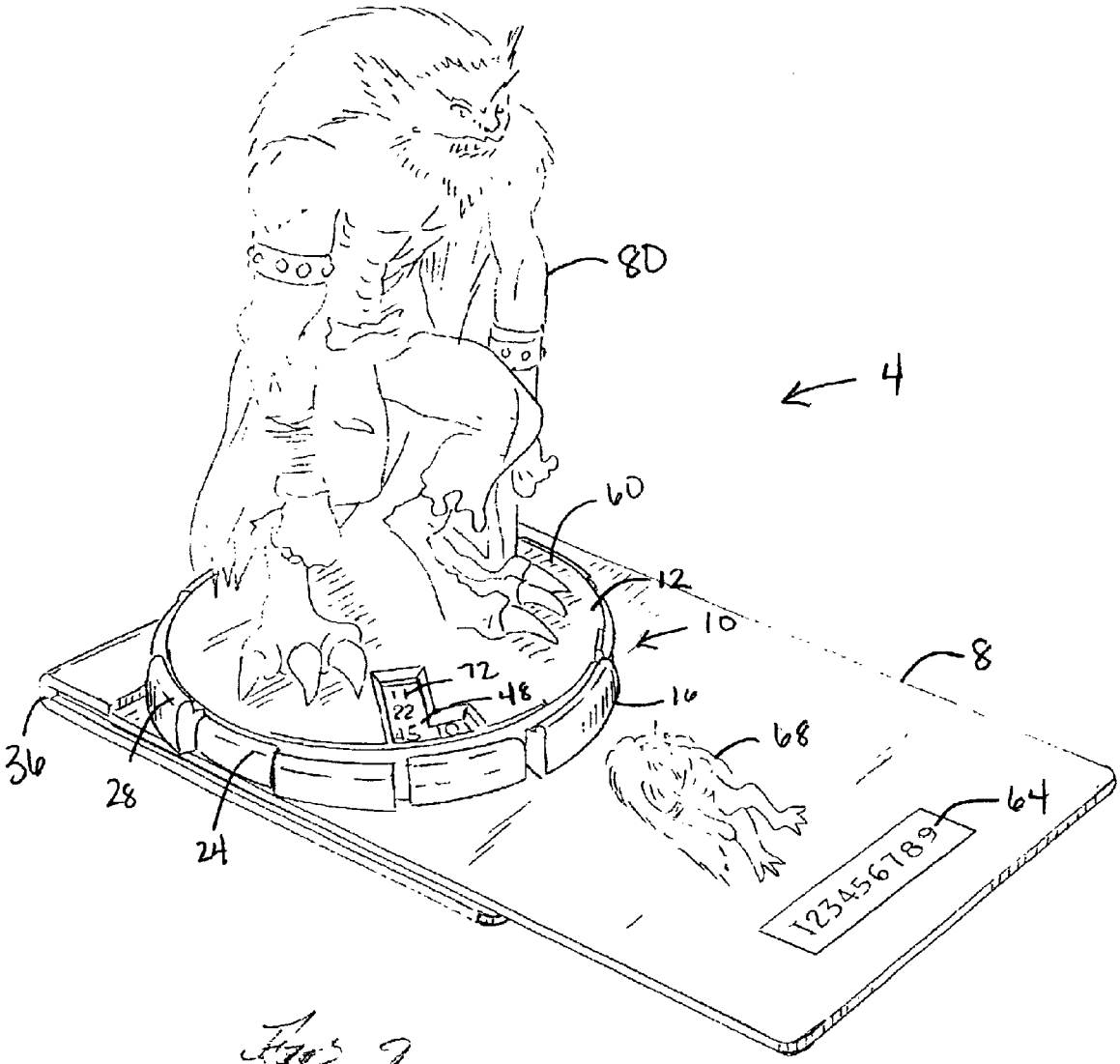

In another embodiment as shown in FIG. 8, the center surface 208 of the selector disk 212 provides some of the character's information 216. In this embodiment, sets of additional variable information 216 are printed directly onto the surface 208 of the selector disk 212. Again, within each column, cut-out windows 220 are alternated with the information 216 to allow some of the printed information 8 that is inserted into the base 200 to show through such that it can be viewed in a stat slot 224 of the game piece 4.

As illustrated in FIG. 9, the same game piece 4 can include a figure 80. In some embodiments, the figure 80 can be attached to the upper surface 60 of the base disk 12. The figure 80 can be any representational figure representing a character in a game. In the illustrated embodiment, the base 10 is shown under the feet of the figure 80. However, it is to be understood that the base 10 is defined as anything that can receive the printed information 8 for use with the game. For example, the base 10 could be on the back of the figure 80. In the illustrated embodiment, the figure 80 matches the illustration 68 on the printed information 8.

In still other embodiments, the figure 80 may be any suitable type of figure, including humans, animals, and mythical, mechanical, or fantastical creatures. The game piece base 10 may be made available in conjunction with or separately from the figure 80 to allow for interchangeability between figure 80 and bases 10, or to allow one to acquire a base 10 to match a figure 80 one already has.

As is described in more detail below, each game piece 4 carries with it on the printed information 8 a complex two dimensional table that reflects a character's performance statistics at up to twelve stages of damage, where each discrete location of the base disk 12 with respect to the selector disk 16 represents a stage of damage. In other embodiments, other numbers of discrete locations can indicate other stages of damage. Thus, the game piece 4 provides both the table and the current performance of the character, eliminating voluminous rulebooks and record-keeping.

Although the invention described herein may be used for a wide variety of games, a game called MAGE KNIGHT REBELLION will be used as an example to illustrate the invention. In MAGE KNIGHT REBELLION, a player takes on the role of a powerful warlord, king, baron, or high wizard who sends his warriors out to do battle with opposing armies. MAGE KNIGHT REBELLION is a game of tabletop combat using collectible MAGE KNIGHT REBELLION figure 80. Each game piece is called a warrior 4, and is a member of one of eight different factions: Atlantis Guild, Elemental League, Necropolis Sect, Black Powder Rebels, Knights Immortal, Orc Raiders, Draconum, or Mage Spawn. A player builds an army from his or her collection of warriors 4. For the purposes of this description, the terms game piece and warrior will be used interchangeably. A game may be played using game pieces 4 with or without an attached figure 80.

A warrior 4 is composed of two main pieces, the figure 80 and the game piece base 10. Printed information 8 containing variable information 72 relating to a character tells a player how good a warrior 4 is at doing certain things. This printed information 8 is inserted into the base 10 of the warrior 4. Each time a warrior 4 takes a point of damage during a game, the player clicks the selector ring 30 clockwise to the next set of numbers. Each point of damage taken by a warrior 4 changes the warrior's game piece base numbers, reducing the warrior's effectiveness. Each time a warrior 4 takes a click of healing during the game, the player clicks the selector disk 16 counter-clockwise to the previous set of numbers. When three skulls show up on the printed information 8, the warrior 4 has been eliminated and is removed from the battlefield.

Each warrior's game piece 4 and/or printed information 8 contains important information. This information includes the warrior's: a) name, b) point value (1–50), c) rank (weak, standard, tough), d) front arc (white), e) rear arc (gray), f) collector's number (1–160), g) faction symbol, and h) combat values. Each warrior's base also has a stat slot (to see numbers on the printed information 8). If a warrior 4 does not have a rank, then it is a unique figure 80. Each warrior 4 has five combat values, four that change during the game and one that stays the same. The four values that change are speed, attack, defense, and damage and are included on the printed information 8. These four values can be seen through the warrior's stat slot 48. The fifth value, range, never changes and is printed on the base 10 or the printed information 8.

Game Items: In addition to a player's MAGE KNIGHT REBELLION warriors 4 and a rules sheet, a player needs the following items to play a MAGE KNIGHT REBELLION game: a) an eighteen inch flexible ruler, b) two six-sided dice and c) printed information 8 for the player's warriors 4. Additionally, a two-foot-long piece of string and a few pennies (used as tokens during the game) may be used as will be further discussed below. Optionally, a player may also collect simple terrain items.

Blank stickers are provided with each pack of MAGE KNIGHT REBELLION warriors 4 for ownership identification. A player writes their initials on the stickers and places them on the bottom of each of that player's warriors 4. This helps a player to sort out which warriors 4 are that player's at the end of each battle.

Building A Player's Army: All of the players must agree to a build total of each player's army. The build total is the total of a player's point values and is always in multiples of 100 points. Each MAGE KNIGHT REBELLION warrior 4 has a point value printed on its game piece base 10. Once a player knows how many points that player has to build an army, that player chooses which of that player's warriors 4 will participate in the game. A player's army may contain two or more of the same figure 80, unless that figure 80 is unique. However, the same unique figure 80 can appear in opposing armies. The total of the player's warriors' point values cannot exceed the build total value.

Beginning the Game: MAGE KNIGHT REBELLION can be played on a flat tabletop. The players designate a square area to play that is at least three feet long on each side. A game can be played with any number of people, but the game is best when there are two, three, or four different armies. Each player selects one edge of the battlefield to be the player's, and then inserts the trading cards 8 into the bases 10 of their warriors 4. The bases 10 of each warrior 4 are then manipulated such that a green square is showing through the stat slot 48. Each player places up to two terrain items in a pile off to the side of the battlefield. The purpose of the terrain will be described in greater detail below. Next, each player rolls two six-sided dice where the highest roll determines the first player. The first player places a terrain item from the pile onto the battlefield in a desired location. This continues in clockwise order until all of the terrain items are positioned on the battlefield. Each player then places a warrior 4 on the battlefield within three inches of the player's edge and at least eight inches away from any other edge of the battlefield, starting with the first player and rotating clockwise until all of the players are positioned.

Turns and Actions: In MAGE KNIGHT REBELLION, players alternate moving their warriors 4 and attacking opposing warriors 4 to win the battle. At the beginning of a player's turn, the player has a certain number of actions. This number is set for the entire game and is dependent upon the build total of the armies. A player gets one action for every one hundred points of that person's build total. For example, if the build total is 200 points, the player receives two actions per turn. During each players turn, that player decides which warriors 4 to give actions, however, the same warrior 4 may not be given two actions in the same turn.

Actions include moving one warrior 4, performing ranged combat with one warrior 4, performing close combat with one warrior 4, or passing. Once a player has completed their allotted actions, it becomes the next player's turn, and the next player gets the same number of actions. Play proceeds with each player taking a turn. Each player may or may not get the same number of actions depending on his army build total. The army build total can, but is not required to be the same. For example, one player could get 300 points and three actions per turn while another player gets 200 points and two actions per turn.

If a player gives an action (other than pass) to the same warrior 4 on two consecutive turns, that warrior 4 takes one point of damage after completing its subsequent action. This damage represents the fatigue caused by taking actions on two consecutive turns. A player may not give any warrior 4 an action (other than pass) on three consecutive turns. If a player has trouble remembering which warrior 4 that player has given an action to on a previous turn, that player can mark that warrior 4 with a token, such as a penny, to remind that player.

Game Concepts: Distances measured for set-up, movement, or ranged combat, are always measured from the center of the game piece base 10. Two or more warriors 4 are in base contact when the bases of each are touching. Friendly figures are warriors 4 that are controlled by the same player or allied teammates, and cannot target other friendly figures. Opposing figures are any warriors 4 that are controlled by an opponent. Status of friendly and opposing figures are set at the beginning of the game and cannot change by treaties or agreements.

Special Abilities: There are special colored blocks on each warrior's trading card 8 that show through the stat slot 48 in the game piece base 10. These colors represent special abilities that warrior 4 has while they are displayed. There are four areas in which a player can find colored blocks representing the warrior's special abilities. These four areas are: 1) behind the move value, 2) behind the attack value, 3) behind the defense value, and 4) behind the damage value through the stat slot 48 on the warrior's game piece base 10. Descriptions of these special abilities appear on the MAGE KNIGHT REBELLION Special Abilities Card, an example of which is shown in FIG. 10. If a special ability is described as optional, the owning player decides if the ability is, or is not, used for the turn.

Movement: A warrior's speed value is shown on its game piece base 10. This is the maximum number of inches the warrior 4 may move when given a move action. When a player moves a warrior 4, the player physically moves the warrior 4 across the battlefield along the exact movement path. This distance can be measured by the flexible ruler. The game piece bases 10 of other warriors 4 block movement, so a player's warrior 4 may not touch or cross the game piece base 10 of any other warriors 4 during its move. When a player When a player finishes moving a warrior 4, the figure 80 may be faced in any direction. If a warrior 4 touches another warrior 4 during movement, the movement ends. A path can alternatively be traced to avoid contact with the other warrior 4. The direction that the figure 80 is facing is important because the warrior 4 may only attack (ranged combat and close combat) out of its front arc and it is at a disadvantage when attacked in close combat through its rear arc.

If a player gives a move action to a warrior 4 that is in contact with the game piece base 10 of an opposing warrior 4, the player must break away from the contact. To break away, the player must roll a six-sided die. If the player rolls a 1, 2 or 3, the warrior 4 fails to break away and may not move this turn, although the warrior 4 may be rotated if desired. If the player rolls a 4, 5, or 6, the player warrior 4 has successfully broken away and may move normally.

If a player's warrior's movement takes it into base contact with one or more opposing warriors 4, those opposing warriors 4 immediately have the option to spin in place to bring any portion of their front arcs into contact with the moving warrior 4.

Ranged Combat: Ranged combat attacks represent everything from bows and gunfire, to magical spells and mind attacks. Each warrior 4 has a range value printed on its game piece base 10. If this value is greater than zero and the warrior 4 is not in contact with the game piece base 10 of an opposing warrior 4, then a player may give that warrior 4 a ranged combat action. This number represents the maximum number of inches that the warriors 4 ranged attack can reach. The number of arrow symbols shown with the warrior's range value is the maximum number of different targets the warrior 4 may attack with each ranged combat action. Certain special abilities allow ranged combat to be resolved against an increased number of targets.

When a player gives a ranged combat action to one of the player's warriors 4, the player marks the warrior's range in inches on a string with a pen or marker (or just holds it with a player's fingers). The player places the end of the string at the center of the figure's game piece base 10 and extends the string to the center of the target's game piece base 10. The path of the string is called the line of fire. If a player is firing at more than one target, the player must draw a line of fire to each of them.

The line of fire must pass through the attacking warrior's front arc, and each target must be within the range a player has marked on the string. The line of fire is blocked if it crosses any warrior's game piece base 10 (friend or foe) other than a target. If the line of fire is blocked, a player may not attack the target warrior 4. A player may check to see if a line of fire is blocked at any time. The attacking player rolls two six-sided dice and adds their values to the warrior's attack value. If the result is equal to or greater than the target's defense value, as shown on its game piece base 10, then the target is hit and damaged. When a player's warrior 4 hits a target with an attack, the target must take a number of clicks of damage equal to the attacker's damage value.

When a warrior 4 is attacking more than one target with a ranged combat attack, which is allowed when the warrior's range value is shown with more than one arrow, a player only rolls the dice once. The total of the dice plus the warrior's attack value is compared to every target's defensive value. Some targets with low defensive values may be damaged by the attack, while others with high defensive values may not be. Whenever a ranged combat action is used to attack more than one single target, the damage value of the attack, if successful, is always one, despite the warrior's normal damage value.

Close Combat: Close combat represents hand-to-hand and melee weapon attacks. If a player gives the close combat action to a warrior 4, the front arc of the warrior's game piece base 10 must be touching the target's game piece base 10. The attacking player rolls two six-sided dice and adds their values to the warrior's attack value. If the result is equal to or greater than the target's defense value as shown on its game piece base 10, then the target is hit and damaged. The player adds one to the dice roll if the warrior 4 is in contact with the rear arc of the target warrior's game piece base 10.

Damage: When a warrior 4 hits a target with a ranged or close combat attack, the warrior 4 inflicts damage in the amount of the warrior's damage value. This is the number of clicks of damage the warrior 4 has delivered to the target. The opposing player must click the target's game piece base 10 clockwise that number of clicks. The damage inflicted reduces the target's abilities, and may even eliminate the target from the game.

Rolling a "2" or a "12": Whenever a warrior 4 is making a ranged or close combat attack and rolls a "2," the warrior 4 automatically misses the target. This is called a critical miss, and the warrior 4 must take one click of damage representing a self-inflicted wound caused by the miss. If a player rolls a "12," the warrior 4 has automatically hit the target and does one extra click of damage. Alternatively, if a player is trying to heal a warrior 4 and rolls a "12," then the healing is automatically successful and delivers one extra click of healing.

Healing: By using special abilities such as magic healing, regeneration, and vampirism, a player may repair damage to a game piece 4. When repairing, click the selector disk 16 counter-clockwise, but never past the figure's starting position.

Capturing: A player has the option in close combat of capturing a target instead of damaging the target. A player must declare a capture attempt before rolling the close combat dice. The defense value of the target warrior 4 is increased by two if a player is attempting to capture it. If a player hits the target, the player doesn't damage the target, but the target is captured and a player's opponent may no longer give the target an action.

Each warrior 4 may only have one captured warrior 4 under that warrior's control. The capture is shown by keeping the captured figure's game piece base 10 in contact with the controlling warrior's game piece base 10 at all times. No warrior 4, friend or foe, may target a captured warrior 4 for any purpose. The captured warrior 4 always moves with the captured warrior's controlling warrior 4 using the lowest of the two figures' movement values. The controlling warrior 4 may only be assigned a move action or a pass action; it may not initiate any further combat. The controlling warrior 4 may not be the target of an opponent's capture attempt. If a warrior 4 with a captured target is eliminated, the captured target may immediately begin operating normally.

Formations: An action that a player gives to one of the player's warriors 4 can affect other warriors 4 in a player's army of the same faction by using formations. Note that a player can never be forced to use a formation if the player does not want to. A formation may never contain figure 80 from different factions, although a player may use different figure 80 from the same faction in a formation. Mage spawn figures may never use formations.

Movement Formation: If three to five of a player's warriors 4 are grouped so that each one's game piece base 10 is touching the game piece base 10 of another, then the player can call this group a movement formation. When a player gives a move action to just one of these warriors 4, all of the warriors 4 in the movement formation may move at the same time and as part of that same action. At the end of the move, each warrior's game piece base 10 must still be touching the game piece base 10 of another warrior 4 in the formation. Therefore, the speed value of the slowest warrior 4 in the movement formation will restrict how far a player's warriors 4 will move. Movement formations are good because one move action allows a player to move several warriors 4 instead of just one. If any warrior 4 in a movement formation fails to break away, that warrior 4 may not move individually other than rotating to a new direction.

Ranged Combat Formations: If three to five of a player's warriors 4 have their game piece bases 10 touching, a player may declare a ranged combat formation. When a player gives a ranged combat action to just one of these warriors 4, all of the warriors 4 in the ranged combat formation contribute to the attack. The target figure 80 must be within the range value of each of a player's warriors 4, and no line of fire may be blocked. The warrior 4 that a player gives the ranged combat action to is called the primary firer. To resolve the attack, a player uses the primary firer's attack value and damage value. Each additional warrior 4 in the ranged combat formation adds one to the attack dice roll. There is no damage bonus. Ranged combat formations are good because they allow a player to hit and at least do some damage to target warriors 4 with very high defensive values. Even if only one warrior 4 in the formation is given the ranged combat action, all warriors 4 are considered to have performed an action.

Close Combat Formations: If two or three of a player's warriors 4 have their game piece bases 10 touching each other and a game piece base 10 of a single opposing warrior 4, a player may declare a close combat formation against that opposing warrior 4. When the player gives a close combat action to just one of a player's warriors 4, all of the warriors 4 in the close combat formation contribute to the attack. The warrior 4 that the player gives the close combat action to is called the primary attacker. To resolve the attack, the player uses the primary attacker's attack value and damage value. Each additional warrior 4 in the close combat formation adds one to the combat dice roll. There is no damage bonus. Close combat formations are good because they help overcome the difficulty in capturing an opponent's warrior 4 or damaging a warrior 4 with a high defensive value. Similar to ranged combat formations, if one warrior 4 in the formation is given the close combat action, all warriors 4 are considered to have performed an action.

If a "2" is rolled during a close combat or ranged combat formation, only the primary attacker rotates his base clockwise one click.

Tabletop Terrain: Players are not required to use terrain when fighting a MAGE KNIGHT REBELLION battle, but adding terrain to the tabletop will make the game more challenging and interesting. There are four types of terrain in MAGE KNIGHT REBELLION: a) clear, b) hindering, c) blocking, and d) elevated. An empty tabletop is considered to be clear terrain.

Hindering Terrain: Examples of hindering terrain are brush, low walls, and debris. A player can represent these with construction paper, pieces of felt, fabric, or scale models. Hindering terrain should lie flat on the table so that the terrain does not interfere with the placement of a player's warriors' game piece bases 10. If a line of fire passes through any amount of hindering terrain or any number of hindering terrain features, one is added to the target's defensive value, this is called a hindering terrain modifier. Close combat attacks are not affected by hindering terrain. A player's warriors 4 can move into and through hindering terrain, but there are restrictions. If a player's warrior 4 begins a move with any part of the warrior's game piece base 10 touching clear terrain, the warrior's movement must end immediately when the warrior's game piece base 10 crosses completely into a hindering terrain feature. If a player's warrior 4 begins a move with any part of the warrior's game piece base 10 touching hindering terrain, the warrior's speed value is cut in half for the turn.

A firer in hindering terrain is not penalized by the modifier if its front arc lies entirely outside of the hindering terrain boundary and the line of fire does not pass into or through any other hindering terrain features. This represents use of the hindering terrain as protection while firing from the edge of the hindering terrain.

Blocking Terrain: Examples of blocking terrain are large trees, high walls, and buildings. A player can represent them with common items such as salt shakers, cups, and stacks of books, or the player can use scale models. Blocking terrain blocks movement, so a warrior 4 may not move through it. Also, blocking terrain blocks any line of fire crossing it.

Elevated Terrain: All elevated terrain is assumed to represent the same level of height above the battlefield. Elevated terrain features include hills and low plateaus. Elevated terrain may include areas of hindering and/or blocking terrain, but is otherwise assumed to contain clear terrain. Players can represent elevated terrain with stacks of books and magazines, or use scale models. All warriors 4 must stop as soon as they move up into elevated terrain, or down out of elevated terrain (as if they were entering a hindering terrain feature). When measuring a player's move, don't measure any vertical distance traveled, just the horizontal portion of the warrior's move along the tabletop or elevated terrain feature.

Elevated terrain features block lines of fire unless the firer or target or both are on the elevated terrain. If both the firer and target are on elevated terrain, nothing affects the line of fire except elevated hindering and blocking terrain features and other elevated figure 80. If the firer or target is on elevated terrain, but the other is not, the line of fire is blocked if it crosses a different elevated terrain feature. Intervening blocking terrain features also block the line of fire, whether elevated or not. Intervening elevated warrior 4 bases will also block these lines of fire, but those off of elevated terrain can be ignored. Hindering terrain modifies the attack only if either the firer or target is in hindering terrain, otherwise it too can be ignored.

Special Terrain: Shallow water features like streams, fords, and ponds are treated as hindering terrain for movement, but have no effect on ranged combat actions. Deep water features like rivers and lakes are treated as blocking terrain for movement, but have no effect on ranged combat actions.

Low walls are special types of hindering terrain. Movement stops when a player's warrior 4 reaches the far side of a low wall, and speed is never halved on subsequent turns when that player's warrior 4 moves away from a low wall. Ranged combat attacks use the hindering terrain modifier for crossing the low wall, except if the firer is in base contact with the low wall. Close combat attacks are allowed between adjacent warriors 4 on opposite sides of a low wall as if they were in base contact.

Abrupt elevated terrain such as raised parapets, flat rooftops, and plateaus flanked by cliffs are treated like normal elevated terrain except that close combat attacks are not allowed. Formations are also not allowed to be broken between levels of an abrupt elevated terrain. Warriors 4 may only move onto or off of such terrain if they have special abilities or a ladder or stairway exists.

Height Advantage: When a firer that is not on elevated terrain makes a ranged combat attack against an elevated target, the target's defense value is increased by one. This is the height advantage modifier. When using a ranged combat formation, only the primary attacker's line of fire is subject to the height advantage modifier and the hindering terrain modifier.

Close combat between warriors 4 at different elevations is allowed if the bases 10 would be in contact if not for the height difference. If the target of a close combat attack is elevated while the attacking warrior 4 is not, the target gets the height advantage modifier.

Ending the Game: The game ends when any of the following occur: a) Only one player remains with a warrior 4 on the battlefield; b) A predetermined time limit for the game expires; or c) All remaining players agree to end the game. A player may also decide to withdraw during their turn. If a player decides to withdraw, the player removes all of the player's remaining warriors 4 from the game.

The winner of the game is determined by the player with the highest number of victory points. Victory points are accumulated by eliminating opposing warriors 4, maintaining captured warriors 4, and by one's own surviving warriors 4. The points awarded for eliminating an opposing warrior 4 is the point value of that warrior 4. The points awarded for holding a warrior 4 captive at the end of the game is twice the point value of the captured warrior 4. The points accumulated for each surviving warrior 4 is equal to that warrior's point value. After the game, all players retrieve their eliminated and captured warriors 4.

Various features of the invention are set forth in the following claims.

What is claimed is:

1. A game piece for use in a game, the game piece comprising:

a base; and printed information relating to a character in the game, insertable into and interchangeable with the base, wherein the printed information includes variable information, and wherein the base adjustably displays the variable information, wherein the base includes additional variable information and wherein the base adjustably displays both the variable information and the additional variable information, wherein the base includes a selector disk, a base disk, and a label between the base disk and the selector disk, the label including the additional variable information and cut-out windows randomly arranged in a plurality of groups, such that when the printed information is inserted into the base, the variable information shows through the cut-out windows, and wherein the base disk limits viewing to one group at a time.

2. A game piece for use in a game, the game piece comprising:

a base; and printed information relating to a character in the game, insertable into and interchangeable with the base, wherein the printed information includes variable information, and wherein the base adjustably displays the variable information, wherein the base includes additional variable information and wherein the base adjustably displays both the variable information and the additional variable information, wherein the base includes a selector disk and a base disk, wherein the selector disk has the additional variable information and cut-out windows arranged in a plurality of groups, such that when the printed information is inserted into the base, the variable information shows through the cut-out windows on the selector disk, and wherein the base disk limits viewing to one group at a time.

3. The game piece of claim 2, wherein the base includes a mechanism to limit viewing of the information.

4. The game piece of claim 3, wherein the base includes a selector disk and a base disk having an aperture therein.

5. The game piece of claim 4, wherein the base disk is rotatable relative to the selector disk between a plurality of indexed positions.

6. The game piece of claim 4, wherein the variable information is arranged in a plurality of groups, and wherein the base disk limits viewing to one group at a time in the indexed positions.

7. The game piece of claim 6, wherein the printed information is a trading card.

8. The game piece of claim 6, wherein one of the base disk and selector disk has an edge including a plurality of indentations, and the other of the base disk and selector disk has a button interactable with the plurality of indentations defining the plurality of indexed positions.

9. A game piece for use in a game, the game piece comprising:

a figure;

a base coupled to the figure; and printed information that contains variable information relating to the game, the variable information being arranged in a plurality of groups, wherein the base is adapted to receive the printed information, and wherein the base selectively displays the variable information, wherein the base includes a base disk and a selector disk, wherein the base disk is rotatable relative to the selector disk between a plurality of finite indexed positions, wherein the base further includes a label between the base disk and the selector disk, the label including the additional variable information and cut-out windows arranged in a plurality of groups, such that when the printed information is inserted into the base, the variable information shows through the cut-out windows, and wherein the base disk limits viewing to one group at a time in the indexed positions.

10. A game piece for use in a game, the game piece comprising:

a figure;

a base coupled to the figure; and printed information that contains variable information relating to the game, the variable information being arranged in a plurality of groups, wherein the base is adapted to receive the printed information, and wherein the base selectively displays the variable information, wherein the base includes a base disk and a selector disk, wherein the base disk is rotatable relative to the selector disk between a plurality of finite indexed positions, wherein the selector disk includes the additional variable information and cut-out windows arranged in a plurality of groups, such that when the printed information is inserted into the base, the variable information shows through the cut-out windows on the selector disk, and wherein the base disk limits viewing to one group at a time in the indexed positions.

11. The game piece of claim 10, wherein the figure represents a character in the game.

12. The game piece of claim 11, wherein the character has characteristics related to the game, and wherein the variable information represents the characteristics.

* * * * *